United States Patent [19]

Brown

[11] 4,122,791

[45] Oct. 31, 1978

[54] METHOD AND APPARATUS FOR SCORING AN ENAMELED METAL SURFACE

[75] Inventor: Omar L. Brown, Dayton, Ohio

[73] Assignee: Dayton Reliable Tool & Manufacturing Company, Dayton, Ohio

[21] Appl. No.: 811,958

[22] Filed: Jun. 30, 1977

[51] Int. Cl.[2] ..... B21D 51/38

[52] U.S. Cl. ..... 113/121 C; 113/15 A; 113/121 B

[58] Field of Search ..... 113/15 R, 15 A, 121 C; 220/265, 266, 269, 270, 276

[56] References Cited

U.S. PATENT DOCUMENTS

| | | | |
|---|---|---|---|
| 3,254,790 | 6/1966 | Dunn | 220/270 |
| 3,687,099 | 8/1972 | Franek | 113/15 A |
| 3,688,718 | 9/1972 | Schrecker | 113/15 A |
| 3,701,330 | 10/1972 | Kinkel | 113/15 A |
| 3,728,980 | 4/1973 | Fraze | 113/1 F |
| 3,900,128 | 8/1975 | Brown | 113/15 A |

*Primary Examiner*—Michael J. Keenan
*Attorney, Agent, or Firm*—Smyth, Pavitt, Siegemund, Jones & Martella

[57] ABSTRACT

A method of scoring an enameled metal sheet to form a line of weakness in the sheet while minimizing disruption of the enameled coating. The enameled surface is placed in contact with an anvil having a flat surface portion. The flat surface portion extends a relatively short distance in a transverse direction on either side of the desired line of score with angled surface portions of the anvil extending downwardly from the flat surface portion to create void spaces between the angled surface portions and the metal sheet. A scoring tool is then brought into forcible contact with the metal sheet along the desired line of score. The scoring tool includes a scoring edge which contacts the metal sheet with the scoring tool having inclined side surfaces which are angled outwardly away from the scoring edge. The inclined side surfaces displace metal within the metal sheet in a downward direction away from the line of score. As metal within the sheet is, thus displaced, the displaced metal flows into the void spaces with the angled surface portions making an angle with the flat surface portion of the anvil that is sufficient to provide uniform downward flow of the metal along the angled surface portions. This permits movement of displaced metal within the metal sheet, minimizing disruption of the enameled coating of the sheet as a result of scoring. An apparatus for scoring an enameled sheet to form a line of weakness therein in accord with the above method.

12 Claims, 4 Drawing Figures

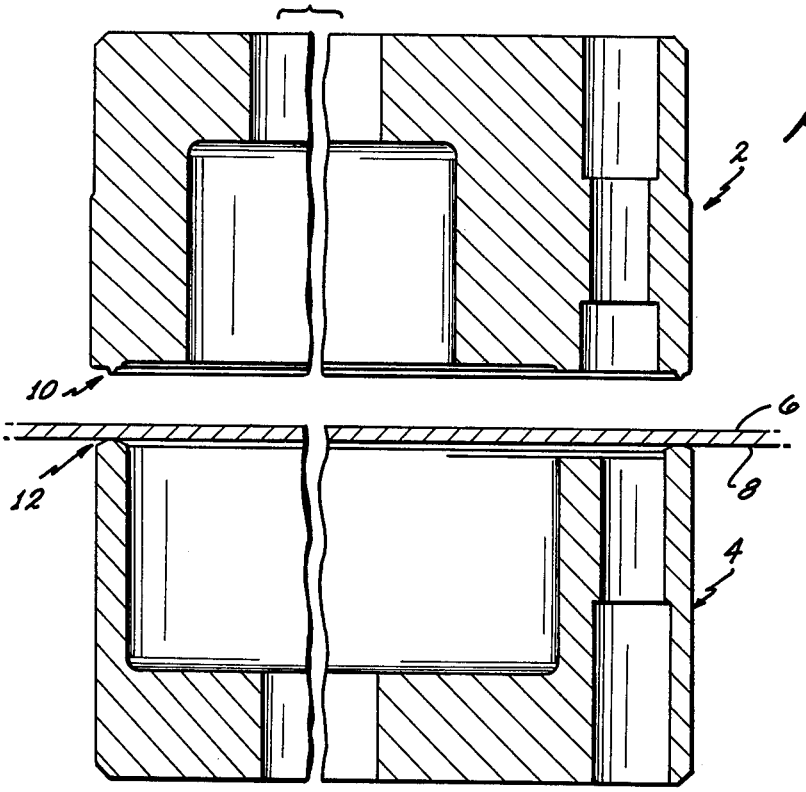
FIG. 1
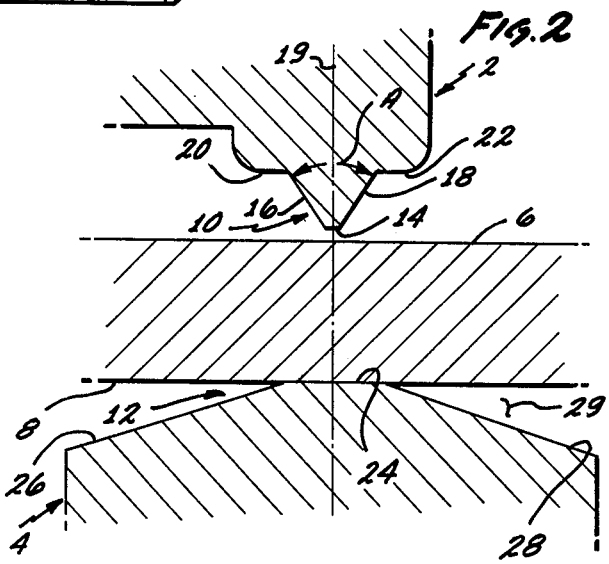
FIG. 2
FIG. 3
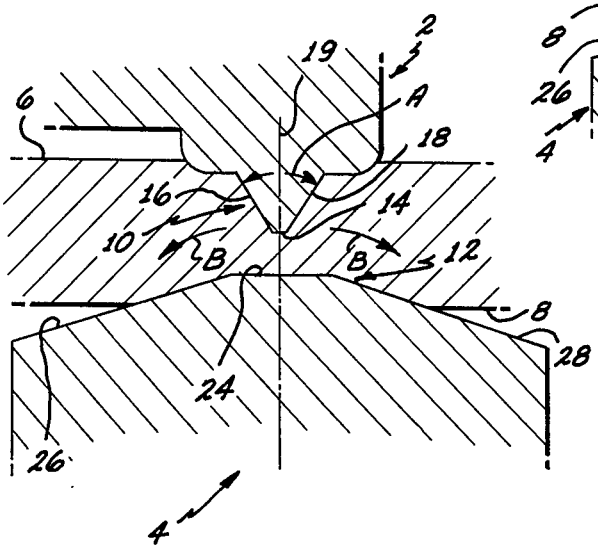
FIG. 4
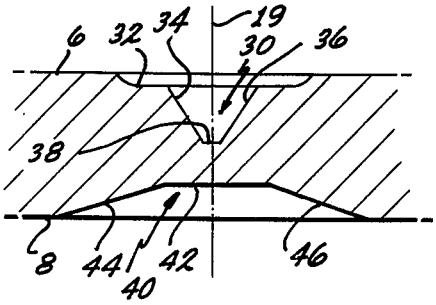

METHOD AND APPARATUS FOR SCORING AN ENAMELED METAL SURFACE

BACKGROUND OF THE INVENTION

Metal sheet material having an enamel coating on one surface is used extensively in the formation of beverage containers. Soft drink beverages are capable of reacting with an exposed metal surface, such as an aluminum surface. Thus, the surface of the container which is contacted by the beverage must include a protective coating to prevent an undesired reaction between the beverage and the container surface.

A can end for a beverage container is customarily scored to define a line of weakness in the can end. During usage of the can, the line of weakness in the can end may be ruptured by a rupturing tool which applies a localized high force to the can end at the line of weakness. The rupturing tool may take the form of an opening tab which is physically secured to the can end. A conventional means of securing an opening tab to a can end involves the formation of an upstanding hollow rivet from the thin metal of the can end, which rivet may then be positioned within an aperture in the opening tab. The hollow rivet may then be compressed to form an enlargment at the outer end of the rivet to secure the opening tab to the can end by enlargement of the rivet.

With an opening tab, thus, secured to the can end, the movement of the opening tab relative to the can end may apply a rupturing force to the can end along the line of weakness therein. As the can end is, thereby, ruptured, an opening may be provided in the can end. The nature of the opening and its form relative to the can end in many instances is determined by the nature of the product within the container. If, for example, the product is a liquid beverage, the opening formed in the can end may provide an opening for pouring the beverage from the container. Conversely, if the product within the container is a solid, the opening formed in the can end may encompass almost the entire can end. Such a can end is commonly termed a "full-panel pull-out," and may be used, for example, with a wide variety of products, such as potato chips, party dips, and the like.

With the emphasis now placed on ecology, can ends with removable tear strips have received a great deal of criticism. In fact, in some states, beverage containers having removable tear strips have been outlawed because of fears that users of the containers would create objectionable litter by leaving removable tear strips in public places, such as on beaches, etc., where they could be a possible source of injury.

Because of the emphasis on ecology, can ends are now being constructed which have tear strips that are not removable from the can end. In use of such ends, the tear strip, after being broken away from the can end along the line of weakness, still remains connected to the can end through a connecting strip. A free end of the tear strip may then be forced through the opening in the can end that is formed by severing the line of weakness such that the tear strip then extends into the interior of the can where it is out of the way and does not interfere with the use of the can.

In any of the foregoing can end constructions, the interior surface of the can and the can end may have a protective coating thereon if the contents of the can are reactive with an exposed metal surface of the can. As stated, this is particularly necessary in cans which contain soft drink beverages. However, the scoring of a metal sheet material having a protective coating during the formation of a can end may present considerable problems.

During scoring, the protective coating on the interior or non-public surface of the can end may be broken. When this occurs, the contents of the container may then be able to react with the exposed metal surface caused by the break in the protective coating. This may cause spoilage of the can contents which may cause considerable loss to the manufacturer in recalling the cans with spoiled product from the inventories of the merchants in the distribution chain for the product. Such an occurrence could be disastrous to the manufacturer. Thus, it is imperative that the protective coating on the non-public side of the can end remain intact during the formation of the can end.

To insure that the protective coating on the interior surface of the can end is intact after scoring the can end to create a line of weakness therein, it has been necessary, in some instances, to resurface the non-public side of the can end with a new protective coating after scoring the can end. This may be an expensive operation since individual can ends may be more difficult to process during coating than a sheet of metal as used in forming the can ends. Thus, the formation of a protective coating on the non-public side of the can ends after scoring of the ends is not a satisfactory solution to the problem of insuring the presence of a complete protective coating on the non-public surfaces of the can ends. However, at the same time, the potential economic impact on a manufacturer of having to recall cans because of spoilage caused by reaction of the product with exposed metal at a break in the protective coating poses a risk which is not acceptable.

In view of the above difficulties, it would be desirable if a procedure could be devised for forming a line of weakness in a metal sheet with a protective coating thereon without causing a break in the protective coating at the line of weakness. This would permit the formation of can ends in a more direct and inexpensive manner without having to resurface the can ends after completing the metal-forming operations thereon. Also, such a procedure would substantially eliminate the risk of causing a break in the protective coating on the interior surface of the can ends during formation of a line of weakness in the can ends.

SUMMARY OF THE INVENTION

In providing a solution to the aforementioned problem, the present invention includes a method for scoring an enameled metal sheet to form a line of weakness therein while minimizing disruption of the enameled coating of the sheet. In accord with the method, the enameled lower surface of the metal sheet is placed in contact with an anvil. The anvil has a flat surface portion which underlies the desired line of score on the metal sheet with the flat surface portion extending a short distance in a transverse direction on either side of the desired line of score. Additionally, the anvil has angled surface portions which extend downwardly from the flat surface portion to create void spaces between the angled surface portions and the metal sheet.

A scoring tool is then brought into forcible contact with the upper surface of the metal sheet along the desired line of score. The scoring tool includes a scoring edge and inclined side surfaces which are angled inwardly toward the scoring edge. On contact of the scoring tool with the metal sheet, the side surfaces of the scoring tool cause a displacement of metal within the sheet in a downward and transverse direction away from the line of score. The angled surface portions of the anvil make an angle relative to the flat surface portion of the anvil which is sufficient to provide uniform downward flow of the metal within the sheet along the angled surface portions as the scoring tool contacts the metal sheet. This minimizes disruption of the enameled coating on the metal sheet during the formation of the line of weakness or line of score in the metal sheet.

In addition to the aforementioned method, the present invention provides an apparatus for scoring an enameled metal sheet to form a line of weakness in the sheet while minimizing disruption of the enamel coating on the sheet. Additionally, the apparatus includes a scoring tool which makes forcible contact with the metal sheet during scoring in forming a line of weakness in the sheet.

The anvil has a flat surface portion which underlies the desired line of weakness on the metal sheet. The flat surface portion extends a short distance on either side of the desired line of weakness with angled surface portions on the anvil extending downwardly from the flat surface portion to form void spaces between the angled surface portions and the metal sheet.

The scoring tool of the apparatus includes inclined side surfaces and a scoring edge, with the inclined surfaces being angled inwardly toward the scoring edge. The scoring tool is positioned in alignment with the anvil such that the scoring edge is positioned above the flat surface portion of the anvil during movement of the scoring tool against the metal sheet to form a line of weakness therein. The inclined side surfaces of the scoring tool displace metal within the sheet in a transverse direction away from the desired line of weakness on contact of the scoring tool with the metal sheet. Additionally, the inclined side surfaces on the scoring tool displace metal within the sheet in a downward direction on contact of the scoring tool with the sheet.

The angled surface portions of the anvil have an angle relative to the flat surface portion of the anvil which provides a generally uniform downward flow of displaced metal within the metal sheet. This flow of metal is directed along the angled surface portions into the void spaces between the angled surface portions and the metal sheet. Thus, stresses within the metal sheet which would tend to disrupt the protective coating formed on the lower surface of the metal sheet are minimized during scoring of the sheet.

THE DRAWING

In illustrating a preferred embodiment of the invention, reference is made to the accompanying drawing, in which:

FIG. 1 is a sectional view of a scoring tool positioned above an anvil with a metal sheet having a protective coating on its lower surface being positioned in contact with the anvil;

FIG. 2 is an enlarged sectional view illustrating the configuration of the scoring surface of the scoring tool and the configuration of the anvil surface of the anvil relative to the metal sheet supported by the anvil surface;

FIG. 3 is an enlarged sectional view, similar to FIG. 2, illustrating the position of the scoring tool after movement of the tool against the metal sheet supported by the anvil surface with displaced metal within the sheet flowing smoothly in contact with the anvil surface to minimize disruption of the protective coating on the surface of the sheet, and FIG. 4 is an enlarged sectional view of the metal sheet demonstrating the configuration of the line of weakness formed therein in accord with the present invention.

DETAILED DESCRIPTION

FIG. 1 illustrates a scoring apparatus of the invention in which a scoring tool 2 is positioned above an anvil 4 with a sheet of metal 6 positioned therebetween. The sheet of metal includes an enameled lower surface 8 which may form a protective coating on the non-public surface of a can end manufactured from the metal sheet. As indicated, the scoring tool 2 may include a scoring surface generally indicated as 10 while the anvil 4 may include an anvil surface generally indicated as 12. The scoring surface 10 is positioned in alignment with the anvil surface 12 with the scoring surface moving toward the anvil surface, as will be described, in forming a line of weakness in the metal sheet 6.

FIG. 2 is an enlarged cross-sectional view illustrating the structure of the scoring surface 10 and anvil surface 12. The scoring surface 10 includes a score edge 14 with inclined surfaces 16 and 18 which form an included angle indicated by the arrow A. The inclined surfaces 16 and 18 are positioned equally with respect to a center line 19. Thus, the angle made by either of the surfaces 16 or 18 with the center line 19 is equal to half of the total included angle A.

Additionally, the inclined surfaces 16 and 18 are joined to flat surfaces 20 and 22 which are positioned transversely to the center line 19. With movement of the scoring tool 2 in a direction along the center line 19, the flat surfaces 20 and 22 may contact the upper surface of the metal sheet 6 to form coined areas on the metal sheet on either side of the line of weakness. In making reference to center line 19, it should be understood that the scoring surface 10 may have a complex configuration when observed in plan view, i.e., looking upwardly at the scoring tool 2 from the surface of metal sheet 6. Thus, the center line 19 has reference to only a single plane passing through the scoring surface 10. The scoring surface 10 may, for example, have a circular configuration when observed in plan view to form a circular line of weakness on the metal sheet 6. In this case, the center line 19 would, then, be merely one line of a family of lines whose locus is a right cylinder that contains the scoring edge 14.

As discussed, the metal sheet 6, with an enameled lower surface 8 may be supported on an anvil 4. The anvil 4 may include a score support surface 24 positioned beneath the desired line of weakness on the metal sheet 6. As indicated, the score support surface 24 is positioned in alignment with the score edge 14. Thus, the center line 19 for scoring surface 10 may also be the center line for score support surface 24. The score support surface 24 may have a width of about 0.010 inches, while the score edge 14 may, for example, have a width in the order of 0.001 inches. The anvil surface 12 includes inclined surfaces 26 and 28 which are joined to score support surface 24. As indicated, the inclined surfaces 26 and 28 may form equal angles with the score support surface 24 and also with the lower surface of metal sheet 6. Typically, the inclined surfaces 26 and 28 may each form an angle of about 17° with the lower surface of metal sheet 6 to provide void regions 29 between the inclined surfaces and the lower surface of the metal sheet.

FIG. 3 is an enlarged cross-sectional view similar to FIG. 2, illustrating the movement of the scoring tool 2 into contact with metal sheet 6 in forming a line of weakness therein. As tjhe scoring tool 2 is brought into contact with metal sheet 6, the scoring surface 10 penetrates the metal sheet. Because of the inclination of surfaces 16 and 18, when the scoring surface 10 penetrates the metal sheet 6, metal is displaced within the sheet in the direction indicated by the arrows B. This displacement of metal may cause large stresses within the metal sheet 6, and it is these stresses which have previously caused difficulties in maintaining a continuous protective coating, such as the coating 8, during scoring of the metal sheet 6.

I have discovered that, by properly positioning the inclined surfaces 26 and 28 with respect to score support surface 24, it is now possible to form a line of weakness in a metal sheet having a protective coating thereon without disrupting the protective coating. This is accomplished by controlling the angle of the inclined surfaces 26 and 28 with respect to the score support surface 24 so that metal which is displaced in the direction of arrows B can flow smoothly in a downward direction along surfaces 26 and 28 in a direction transverse to the line of weakness. As the displaced metal is, thus, permitted to flow, a line of weakness may be formed in the metal sheet 6 without disrupting the protective coating 8.

As described, the included angle A is formed between the inclined surfaces 16 and 18 of the scoring tool 2. The present method and apparatus may be utilized in scoring various metals, such as, for example, aluminum or tin-plated steel. The included angle A may be varied, as determined by the nature of the metal forming the sheet 6. For example, steel is harder than aluminum and the included angle A may, therefore, be greater for steel than for aluminum. Typically, for example, the included angle A may be in the order of 70° for scoring of a steel surface, and may be in the order of only 50° for the scoring of an aluminum surface. As the angle A is decreased, for example, from 70° to 50°, the scoring surface 10 becomes more pointed and has a sharper profile. The use of a scoring surface 10 with a sharper profile is easier in scoring a softer metal, such as aluminum. However, the use of an included angle A which is larger is desirable for scoring a harder metal, such as steel, since the scoring tool then has an enlarged cross-sectional area and is stronger.

FIG. 4 is an enlarged cross-sectional view similar to FIGS. 2 and 3, which demonstrates the appearance of the metal sheet 6 after the formation of a line of weakness therein. As indicated, the penetration of the scoring surface 10 into the metal sheet 6 provides a score cavity 30 therein. Depending upon the force applied to the scoring tool 2 during the formation of a line of weakness, transverse indentations 32 may be formed on either side of the score cavity 30. The transverse indentations 32 may be formed by contact of the flat surfaces 20 and 22 (see FIG. 2) with the upper surface of the metal sheet 6. The transverse indentations 32 are, thus, coined areas on the metal sheet 6 which are positioned on either side of the line of weakness in the sheet which is formed by the score cavity 30.

It is not essential in forming a line of weakness that the transverse indentations 32 be formed on either side of the score cavity 30. Thus, if the line of weakness in metal sheet 6 is formed by applying a lesser force against the metal sheet by the scoring tool 2, the flat surfaces 20 and 22 may not make contact with the metal sheet and transverse indentations 32 may not be formed on either side of the score cavity 30.

As indicated in FIG. 4, the score cavity 30 may include inclined side walls 34 and 36 which correspond in shape and position to the inclined surfaces 16 and 18 of scoring tool 2. Likewise, the score cavity 30 may include a score bottom 38 which corresponds in shape and position to that of the score edge 14 during the penetration of the scoring surface 10 into the metal sheet 6 in forming a line of weakness therein.

In addition to the score cavity 30 on the upper surface of the metal sheet 6, as indicated in FIG. 4, a flow cavity 40 may be formed on the lower surface of the metal sheet through contact therewith of the anvil surface 12 during formation of a line of weakness. The flow cavity 40 may include a flat surface 42 which corresponds in shape and position to the score support surface 24 of the anvil 4. Additionally, the flow cavity 40 may include flow surfaces 44 and 46 which correspond with inclined surfaces 26 and 28, and their position, as illustrated in FIG. 3, during formation of the line of weakness in the metal sheet 6.

As described, the movement of displaced metal during the scoring operation is facilitated by the position of inclined surfaces 26 and 28 on the anvil 4. The inclined surfaces 26 and 28 permit the displaced metal to flow smoothly along the inclined surfaces while minimizing the stresses to the enameled lower surface 8 of the metal sheet 6. For this reason, disruptive forces applied to the enameled lower surface 8 during the scoring operation are minimized such that the integrity and continuity of the enameled lower surface 8 is maintained. Thus, any need for resurfacing the metal sheet 6 after formation of a line of weakness therein to repair breaks in the protective coating 8 is substantially eliminated.

I claim:

1. A method for scoring an enameled metal sheet to form a line of weakness in said sheet while minimizing disruption of the enamel coating on said sheet during scoring, said method comprising:

placing the enameled lower surface of the metal sheet in contact with an anvil;

said anvil having a flat surface portion which underlies the desired line of score on the metal sheet;

said flat surface portion extending a short distance on either side of the desired line of score;

said anvil having angled surface portions which extend downwardly from said flat surface portion to create void spaces between the angled surface portions and said metal sheet;

bringing a scoring tool into forcible contact with the upper surface of the metal sheet along the desired line of score;

said scoring tool having a scoring edge and inclined side surfaces which are angled inwardly toward the scoring edge with the side surfaces displacing metal in said sheet in a downward and transverse direction away from the line of score as the scoring tool makes forcible contact with the metal sheet, and providing said angled surface portions of the anvil with an angle relative to said flat surface portion which is sufficient to provide a uniform downward flow of the metal of said sheet along the angled surface portions as the sheet is contacted by the scoring tool in minimizing disruption of the enamel coating of said sheet.

2. The method of claim 1 including providing the angled surface portions of the anvil with an angle of about 17° with respect to said flat anvil surface portion.

3. The method of claim 1 wherein the metal sheet is formed of steel and including providing the side surfaces with an included angle of about 70° or greater.

4. The method of claim 1 wherein the metal sheet is formed of aluminum or an aluminum alloy and including providing the side surfaces with an included angle of about 50° or less.

5. The method of claim 2 wherein the metal sheet is formed of steel and including providing the side surfaces with an included angle of about 70° of greater.

6. The method of claim 2 wherein the metal sheet is formed of aluminum or an aluminum alloy and including providing the side surfaces with an included angle of about 50° or less.

7. An apparatus for scoring an enameled sheet to form a line of weakness in said sheet while minimizing disruption of the enamel coating on said sheet during scoring which includes an anvil to support said sheet during scoring by contact of the anvil with the enamel coating on the sheet and a scoring tool which makes forcible contact with the sheet during scoring to form a line of weakness in the sheet, the improvement comprising:

said anvil having a flat surface portion which underlies the desired line of weakness on the metal sheet;

said flat anvil surface portion extending a short distance on either side of the said desired line of weakness;

angled surface portions on said anvil which extend downwardly from said flat surface portion to form void spaces between the angled surface portions and said metal sheet;

inclined side surfaces on said scoring tool;

a scoring edge on said scoring tool;

said inclined side surfaces being angled inwardly toward said scoring edge;

said scoring tool being positioned in alignment with said anvil such that said scoring edge is positioned above said flat surface portion on movement of the scoring tool against the metal sheet in forming a line of weakness therein;

said inclined side surfaces of the scoring tool displacing metal in said sheet in a transverse direction away from the desired line of weakness on contact of the scoring tool with the metal sheet;

said inclined side surfaces of the scoring tool also displacing metal in the metal sheet in a downward direction on contact of the scoring tool with said metal sheet, and said angled surface portions of the anvil having an angle relative to said flat surface portion which provides a generally uniform downward flow of displaced metal within the metal sheet directed along the angled surface portions into the void spaces between the angled surface portions and the metal sheet.

8. The apparatus of claim 7 wherein said angled surface portions of the anvil form an angle of about 17° with respect to said flat anvil surface portion.

9. The apparatus of claim 7 wherein said side surfaces form an included angle of about 70° or greater, whereby said apparatus is particularly suitable for scoring steel sheets.

10. The apparatus of claim 7 wherein said side surfaces form an included angle of about 50° or less, whereby said apparatus is particularly suitable for scoring aluminum sheets.

11. The apparatus of claim 8 wherein said side surfaces form an included angle of about 70° or greater, whereby said apparatus is particularly suitable for scoring steel sheets.

12. The apparatus of claim 8 wherein said side surfaces form an included angle of about 50° or less, whereby said apparatus is particularly suitable for scoring aluminum sheets.

* * * * *